US007477008B2

(12) United States Patent
Artmann et al.

(10) Patent No.: US 7,477,008 B2
(45) Date of Patent: Jan. 13, 2009

(54) PLASMA JET SPARK PLUG

(75) Inventors: Reinhard Artmann, Eichenau (DE); Michael Hallmannsegger, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 11/328,071

(22) Filed: Jan. 10, 2006

(65) Prior Publication Data

US 2006/0137642 A1 Jun. 29, 2006

Related U.S. Application Data

(63) Continuation of application No. PCT/EP2004/005286, filed on May 17, 2004.

(30) Foreign Application Priority Data

Jul. 10, 2003 (DE) ..... 103 31 418

(51) Int. Cl.
*H01T 13/20* (2006.01)

(52) U.S. Cl. ..... 313/143; 313/141

(58) Field of Classification Search ..... 313/143, 313/128, 118, 124, 137, 130, 141, 120, 123, 313/142

See application file for complete search history.

(56) References Cited

U.S. PATENT DOCUMENTS

| | | | | |
|---|---|---|---|---|
| 3,719,850 | A * | 3/1973 | Schafer | 313/118 |
| 4,219,001 | A | 8/1980 | Kumagai et al. | |
| 4,354,136 | A * | 10/1982 | Hamai et al. | 313/139 |
| 4,388,549 | A * | 6/1983 | Bensman | 313/138 |
| 4,396,855 | A * | 8/1983 | Imai et al. | 313/139 |
| 4,644,218 | A * | 2/1987 | Kirkhouse | 313/120 |
| 4,766,855 | A | 8/1988 | Tozzi | |
| 4,795,937 | A * | 1/1989 | Wagner et al. | 313/130 |
| 4,951,173 | A | 8/1990 | Suzuki et al. | |
| 4,963,784 | A * | 10/1990 | Niessner | 313/131 R |
| 5,051,651 | A * | 9/1991 | Kashiwara et al. | 313/139 |
| 5,310,373 | A * | 5/1994 | Treiber et al. | 445/7 |
| 5,367,871 | A | 11/1994 | Venkataramani et al. | |
| 5,421,300 | A * | 6/1995 | Durling et al. | 123/266 |
| 6,611,083 | B2 * | 8/2003 | LaBarge et al. | 313/140 |

FOREIGN PATENT DOCUMENTS

| | | |
|---|---|---|
| DE | 115 521 | 10/1975 |
| DE | 40 28 869 A1 | 3/1992 |
| JP | 02-072577 | 3/1990 |
| WO | WO 96/01512 | 1/1996 |

OTHER PUBLICATIONS

International Search Report dated Sep. 2, 2004 w/English Translation (Six (6) pages).
German Search Report dated Feb. 2, 2004 w/English.

* cited by examiner

*Primary Examiner*—Karabi Guharay
(74) *Attorney, Agent, or Firm*—Crowell & Moring LLP

(57) ABSTRACT

A plasma jet spark plug for internal combustion engines includes a center electrode, a shot channel defined by insulation material, and a ground electrode concentric with the shot channel. The center electrode has a conical shape and the ground electrode defines an outlet opening of the shot channel at a distal end of the spark plug. The shot channel has a tapered shape that forms an acceleration zone for plasma that is formed near the conical tip of the center electrode as the plasma moves toward the ground electrode.

9 Claims, 1 Drawing Sheet

PLASMA JET SPARK PLUG

CROSS-REFERENCE TO RELATED APPLICATIONS

This application is a continuation of PCT Application No. PCT/EP2004/005286 filed on May 17, 2004, which claims priority to German Application No. 10331418.0, filed on Jul. 10, 2003. The entire disclosure of these documents are herein expressly incorporated by reference.

BACKGROUND AND SUMMARY OF THE INVENTION

The invention relates to a plasma jet spark plug for internal combustion engines having a center electrode, a shot channel defined by insulation material, and a ground electrode concentric with the shot channel and forming an outlet opening of the shot channel.

With efforts to reduce fuel consumption and pollution emissions by internal combustion engines, there are demands for using a leaner fuel-air mixture (fuel-air mixtures with an air-to-fuel ratio greater than one). This requires the creation of highly effective spark plasmas, which can effectively initiate the combustion of such leaner mixtures.

A spark plug having a central electrode, a shot channel, and a ground electrode has been disclosed in an internet publication by RWTH Aachen, which is accessible on the Internet at http://www.vka.rwth-aachen.de/sfb 224/Kapitel/pdf/kap3 2.pdf.

The RWTH Aachen spark plug is capable of generating a plasma outside the spark plug. However, most of the spark energy is not transmitted to the gas. The depth of penetration of the spark plasma into the gas is low. Therefore, the RWTH Aachen spark plug has only a limited ability to ignite lean fuel-air mixtures.

The object of the present invention is to create a spark plug capable of transmitting most of the spark energy to the fuel-air mixture.

According to the invention, the center electrode of the spark plug is conically shaped and the shot channel has a taper which acts as an acceleration zone for the plasma in its path toward the ground electrode.

The conical shape of the center electrode facilitates the development of a plasma. The design of the shot channel and the acceleration zone effective in its path toward the ground electrode ensure deep penetration of the plasma into the fuel-air mixture and, consequently, an optimum ignition effect even with an extremely lean fuel mixture.

BRIEF DESCRIPTION OF THE DRAWINGS

An embodiment of the present invention is described in greater detail on the basis of the drawings, in which.

DETAILED DESCRIPTION OF THE DRAWINGS

Figure 2:
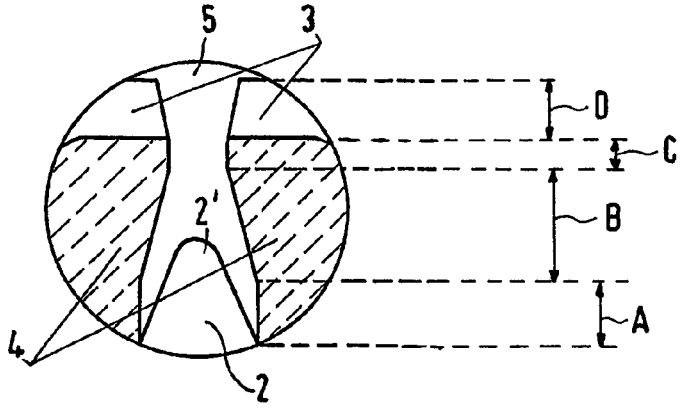
FIG. 2 shows a detail from FIG. 1.
Figure 1:
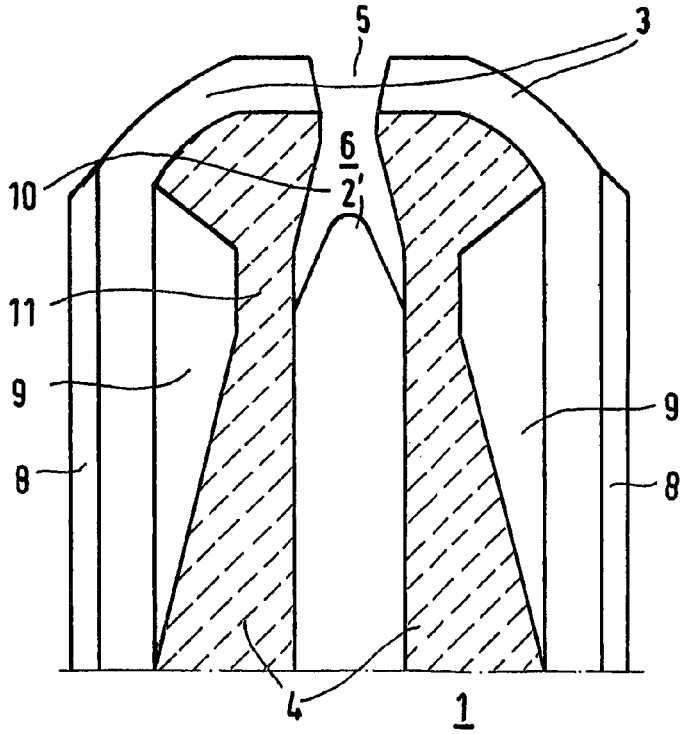
FIG. 1 shows a longitudinal section of an inventive spark plug.

The spark plug 1, details of which are shown in FIGS. 1 and 2, has a center electrode 2, a ground electrode 3 and a ceramic body 4. The center electrode 2 has a conical shape. The ground electrode 3 forms an outlet opening 5 which widens in the form of a funnel toward the outside.

As explained below in greater detail, the plasma is formed in the area of the tip 2' of the center electrode 2. Between the center electrode 2 and the ground electrode 3, a shot channel 6 is formed in the ceramic body 4. In its path toward the ground electrode 3, the channel 6 has a tapered area which acts as an acceleration zone for a plasma.

The ceramic body 4 is in direct contact (i.e., without an air gap) with the ground electrode 3 in the area of the outlet opening. The ground electrode 3 is retracted over the center electrode and has a thread 8 on its outside surface by means of which the spark plug can be screwed into a cylinder head (not shown). In use, the spark plug tip ends approximately flush in a combustion chamber of an internal combustion engine.

Between the ground electrode 3 and the ceramic body 4 there is a toroidal air space 9 which has its greatest extent at the level of the center electrode 2.

Plasma is generated in a hollow chamber 10 in the interior of the spark plug. This hollow chamber is shown on an enlarged scale in FIG. 2.

Without wishing to be bound by theory, the hollow chamber 10 corresponds to a hollow cathode configuration. Between the conically tapering center electrode 2 and the ground electrode 3, which forms the end of the spark plug toward the exterior thereof, an electric field is built up, ionizing the gas in the hollow chamber and generating an electric discharge.

Referring to FIG. 2, the geometric design of the hollow chamber 10 can be defined as comprising a cylindrical area A, which is adjacent to a conically tapered area B, which opens into a cylinder shaped area C. The ground electrode 3 following area C defines the cross section labeled as D, which is conically shaped and represents the distal end of the shot channel 6 thereby formed.

The geometric shape of the hollow chamber 10 has electrotechnical and fluid dynamic advantages, which can guide the electric field in a targeted manner and, through the constriction in area C (akin to flow through a Laval nozzle), create an ultrasonic flow leading to a higher exiting momentum of the plasma.

A rapid rise in plasma temperature (to approximately 6000 K), which occurs with a suitable wiring of the center electrode, can generate a concomitant pressure wave leading to a hypercritical pressure ratio between the static pressure in the hollow chamber 10 and the pressure in a combustion chamber of an engine at the moment of ignition. The result is that the flow in the cylindrical area C corresponding to the narrowest cross section is accelerated to Mach=1, and flow in the divergent part is accelerated to Mach>1.

To form a strong plasma, it is necessary to generate the largest possible spatial area with a high electric field strength. In order for the hot plasma not to be weakened due to wall heat losses by the ceramic insulation, which is a good thermal conductor, it is appropriate to concentrate the electric field at a distal end 2' of the conically tapering center electrode 2. The field line concentration undergoes a decisive focusing effect due to the shape of the ceramic insulation body 4. The lobe shape of the ceramic conducts the electric field lines to the electrode tip 2' because of its dielectric properties. The proportion of the electric field strength allotted to the ceramic is low in comparison with the electric field strength to be expended to overcome the distance across the air space 9. Thus, at a corresponding high voltage between the electrodes, an electric field strength capable of ionizing the space in the hollow chamber 10 prevails in the area of the electrode tip 2'. The design of the electric field is also facilitated by the round shape of the ground electrode 3. In addition, this contour should have an aerodynamically advantageous effect on the design of the combustion chamber.

In the area of transition from the conical center electrode 2 to a cylindrical shape running in the ceramic body 4, ionization is not desirable because the resulting electric discharge would divert its thermal energy directly to the ceramic insulation. For this reason, the ceramic insulation here is tapered 11, i.e., the applied voltage is advantageously divided in such a way that the electric field strength in this area of the center electrode 2 is reduced and therefore ionization is prevented.

The guidance of the electric field described herein results in an optimum directional effect toward the outlet opening 5. The electric charge carriers that are generated undergo a corresponding acceleration so that additional atoms and/or molecules are ionized, resulting in an avalanche effect.

One further advantages of the inventive spark plug design is the elimination of the risk of ignition by incandescence in both hydrogen and gasoline engines. The result is better ignition of the mixture, i.e., a benefit with direct injection engines in particular due to a reduction in emission of unburned hydrocarbons.

A further advantage of the inventive spark plug design is there are no electrodes protruding into the combustion chamber. This results in increased freedom in the design of the combustion chamber, which can be implemented, for example, through the possibility of increasing the compression ratio and the associated increase in thermal efficiency.

A still further advantage of the inventive spark plug design is a possible reduction in hydrocarbon emissions because there are no protruding electrodes that might form a "flame shadow."

All of the above-mentioned references are herein incorporated by reference in their entirety to the same extent as if each individual reference was specifically and individually indicated to be incorporated herein by reference in its entirety.

While the invention has been described with reference to preferred embodiments, it is to be understood that variations and modifications may be resorted to as will be apparent to those skilled in the art. Such variations and modifications are to be considered within the purview and scope of the invention as defined by the claims appended hereto.

We claim:

1. A plasma jet spark plug for internal combustion engines having a center electrode, a shot channel located beyond a distal end of the center electrode at a first end of the spark plug and formed inside insulation material, and a ground electrode concentric with the shot channel and forming an outlet opening at the first end of the spark plug, wherein the center electrode is conically shaped at the first end of the spark plug and the shot channel has a taper formed in the insulation material in its path toward the ground electrode;

wherein the outlet opening is expanded outward in a funnel shape.

2. The spark plug of claim 1, wherein the insulation material appears at the surface of the ground electrode.

3. The spark plug of claim 1, wherein the ground electrode is retracted beyond the center electrode.

4. The spark plug of claim 3, wherein a toroidal air space is provided between the ground electrode and the insulation material.

5. The spark plug of claim 4, wherein the air space has its greatest extent at the level of the center electrode.

6. The spark plug of claim 4, wherein the insulation material has a lobe-shaped surface at the first end of the spark plug and the ground electrode is formed over and in direct contact with the lobe-shaped surface of the insulation material in a region defined by the outlet opening and the toroidal air space.

7. The spark plug of claim 1, wherein the spark plug is adapted to terminate at least approximately flush in a combustion chamber of an internal combustion engine.

8. The spark plug of claim 1, wherein a thread is formed on an outer surface of the ground electrode.

9. An internal combustion engine comprising the spark plug of claim 1.

* * * * *